US008037809B2

(12) United States Patent
Graf et al.

(10) Patent No.: US 8,037,809 B2
(45) Date of Patent: Oct. 18, 2011

(54) PISTON-AND-CYLINDER ASSEMBLY WITH A VARIABLE DIAMETRAL CLEARANCE, AND A CYLINDER FOR USE IN A PISTON-AND-CYLINDER ASSEMBLY WITH A VARIABLE DIAMETRAL CLEARANCE

(75) Inventors: Egerhardt Graf, Joinville (BR); Rodrigo Link, Joinville (BR); Fabio Henrique Klein, Joinville (BR); Cristiano Rafael Schramm, Joinville (BR)

(73) Assignee: Whirlpool S.A., Sao Paulo-SP (BR)

( * ) Notice: Subject to any disclaimer, the term of this patent is extended or adjusted under 35 U.S.C. 154(b) by 699 days.

(21) Appl. No.: 11/996,390

(22) PCT Filed: Jul. 21, 2006

(86) PCT No.: PCT/BR2006/000146

§ 371 (c)(1),
(2), (4) Date: Aug. 27, 2008

(87) PCT Pub. No.: WO2007/009202

PCT Pub. Date: Jan. 25, 2007

(65) Prior Publication Data

US 2010/0186585 A1 Jul. 29, 2010

(30) Foreign Application Priority Data

Jul. 22, 2005 (BR) ..... 0503019-6

(51) Int. Cl.
*F16J 10/02* (2006.01)

(52) U.S. Cl. ..... 92/169.1

(58) Field of Classification Search ..... 92/6 R, 92/169.1; 123/193.2

See application file for complete search history.

(56) References Cited

U.S. PATENT DOCUMENTS

| | | | | |
|---|---|---|---|---|
| 3,916,771 | A | 11/1975 | Nendzig et al. | |
| 7,421,939 | B2 * | 9/2008 | Van Der Blom | 92/6 R |

FOREIGN PATENT DOCUMENTS

| | | |
|---|---|---|
| DE | 236 148 | 5/1986 |
| EP | 1 517 039 | 3/2005 |
| EP | 1 696 124 | 8/2006 |
| JP | 54 077315 | 6/1979 |
| WO | WO 00/65235 | 11/2000 |
| WO | WO 02077457 A1 * | 10/2002 |

OTHER PUBLICATIONS

The International Search Report for PCT Application No. PCT/BR2006/000146; Filed Jul. 21, 2006; Date of Completion Oct. 24, 2006; Date of Mailing Nov. 7, 2006.

The Written Opinion for PCT Application No. PCT/BR2006/000146; Filed Jul. 21, 2006; Date of Completion Oct. 24, 2006; Date of Mailing Nov. 7, 2006.

International Preliminary Examination Report on Patentability.

* cited by examiner (Continued)

*Primary Examiner* — Michael Leslie
(74) *Attorney, Agent, or Firm* — Alston & Bird LLP

(57) ABSTRACT

A piston-and-cylinder assembly, used in cooling sys terns that may include, for example, refrigerators, air-conditioning systems and the like. In order to solve the problems of volumetric loss (or of cooling capacity) of compressors in general, according to the present invention, one foresees configuring the cylinder (11) of the compression chamber in such a manner that the friction will be as low as possible in the phase in which the gas being compresses still does not exert a significant force onto the piston (10) top and will only have a significant effect during the phase in which the gas to be compressed exerts a greater force onto the piston (10), a moment when the volumetric loss impairs the efficiency of the compressor.

8 Claims, 2 Drawing Sheets

PISTON-AND-CYLINDER ASSEMBLY WITH A VARIABLE DIAMETRAL CLEARANCE, AND A CYLINDER FOR USE IN A PISTON-AND-CYLINDER ASSEMBLY WITH A VARIABLE DIAMETRAL CLEARANCE

This application claims priority of brazilin patent case No. PI0503019-6 filed on Jul. 22, 2005 which is hereby incorporated by reference.

The present invention relates to a piston-and-cylinder assembly, as well as to a compression cylinder, particularly applicable to alternating compressors used in cooling systems that may include, for instance, refrigerators, air-conditioning systems and the like. The teachings of the present invention also apply to motors in general that make use of alternating cylinders, for instance, linear compressors and internal combustion engines.

DESCRIPTION OF THE PRIOR ART ON THE BASIS OF FIGURES

As known from the prior art and as can be seen in FIG. 1, in alternating piston compressors 1 used in cooling, the compression of the cooling gas is achieved through the alternating movement of a piston 10 within a cylinder 11 (which configures a compression chamber C of varying size) between minimum and maximum displacement limits provided by the driving mechanism, respectively called lower dead point and upper dead point. The compression chamber is open at one of its ends and closed at the other by said valve plate 5. In order for the movement of the piston 10 to take place in a proper manner, there has to be a difference between the diameters of piston and compression chamber. In the compressors 1 known at present, the piston diameter and compression-chamber diameter are kept constant, characterizing a constant or constantly variable diametral clearance F.

During the functioning of the compressor, the clearance existing between the piston and the compression remains filled with lubrication oil, so as to provide a bearing support to the piston 10, thus preventing it from coming into contact with the compression-chamber walls, which would result in wear of the piston 10 and/or of the compression chamber. This is due to a dissipation of mechanical energy to overcome the viscous friction provided by oil and by the relative movement of the piston with respect to the compression chamber.

When the piston 10 moves from the lower dead point to the upper dead point, the gas existing inside the compression chamber is compressed, which increases its pressure with respect to the pressure of the gas existing in the compressor housing. This creates a pressure differential that tends to expel into the housing a portion of the gas to be compressed, which then leaks through the diametral clearance F. This phenomenon characterizes a volumetric loss (or loss of the cooling capacity) of the compressor, since a compression work has been done on the gas lost through the leak. This loss decreases directly the energetic efficiency of the compressor.

Both the dissipation of mechanical energy and the leakage of gas through the clearance existing between the piston and the compression chamber are strongly influenced by the value of this clearance, so that the lower its value the greater the dissipation of mechanical energy and the smaller the leakage of gas. On the other hand, the higher its value, the lower the dissipation of mechanical energy and the larger the leakage of gas. For this reason, high-efficiency compressors seek to reach a clearance value considered to be optimum, at which the leakage of gas and the dissipation of mechanical energy are such that the energetic efficiency of the compressor will be maximized.

In addition to the diametral clearance F between the piston and the compression chamber, the following factors have an influence on the dissipation of mechanical energy and leakage of gas:

i) diameter of the piston 10,
ii) length of the compression chamber and of the piston 10,
iii) distance traveled by the piston 10,
iv) rotation velocity of the driving shaft,
v) geometry of the driving mechanism,
vi) type of cooling gas used,
vii) type of lubricating oil, and
viii) conditions of functioning of the compressor (pressures and temperatures).

A compressor has a moment when the volumetric loss is maximum. This can be observed in FIG. 2, which shows the position of the piston moving between the lower dead point (LDP) and the upper dead point (UDP).

As can be seen, between the displacement from the lower dead point to the and the upper dead point the volumetric loss is negligible between the crank angle 0° and 125°. The same thing happens in the opposite direction, when the piston moves from the upper dead point UDP to the lower dead point LDP, where the volumetric loss is negligible from 210° to 360°, and a new revolution cycle of the crank begins. Between the angles 125° and 210° (or leakage region LeaR), however, the volumetric loss increases significantly, and so one should take the necessary measures to prevent this low efficiency at this stretch of the piston 10.

One of the forms known from the prior art for overcoming this problems is described in document DE 236148, which describes the use of a piston-and-cylinder assembly having a variable diametral clearance. According to the teachings of this document, one foresees a cylinder that has half the stroke of a piston that has a constant diametral clearance and the other half having a diametral clearance that decreases constantly down to the LDP. In spite of improving the problem of leakage of gas in the leakage region LeaR, it is necessary that the upper portion of the piston should be specially configured, so that, close to the upper dead point UDP, the diametral clearance does not decrease excessively, which would result in a high friction and the consequent loss of efficiency of the compressor as well as fatigue of the piston. In this way, in spite of the fact that the solution described in this document reduces the loss of gas in the leakage region LeaR, it becomes necessary for the piston to be manufactured with differentiated characteristics, which raises the production costs of the piston-and-cylinder assembly.

Another prior-art solution is known from document WO 94/24436. According to the teachings of this document, one foresees a cylinder profile that is configured as a truncated cone, wherein the cylinder diameter at the upper dead point UDP should be smaller than the cylinder 11 diameter at the lower dead point LDP, so that the diametral clearance will follow the rise in pressure inside compression chamber. This solution, in spite of coming up to the expectation of a more precise sealing of the cylinder, does not exhibit a high efficiency, since only in a region closer to the UDP does the pressure in the compression chamber rise significantly.

SUMMARY AND OBJECTIVES OF THE INVENTION

In order to solve the problems of volumetric loss (or loss of cooling capacity) of the compressor (or of similar device), according to the present invention one foresees configuring the cylinder of the compression chamber in such a way that the friction will be as low as possible in the phase where the gas being compressed still does not exert a significant force onto the piston top and will only have a significant effect during the phase in which the gas to be compressed exerts a greater force onto the piston, a moment when the volumetric loss impairs the efficiency of the compressor.

Thus, the present invention is based on the fact that the leakage of gas through the clearance existing between the piston and the compression chamber is a function of the difference in pressures of the gas inside the compression chamber and the housing (not shown). Since the great increase in pressure inside the compression chamber takes place only when the piston is quite close to the upper dead point, the leakage of gas occurs only at the final instants of compression. Thus, one concludes that the diametral clearance existing between the piston and the compression chamber should be small only when the piston comes close to the upper dead point. In this way, the leakage of gas through the clearance existing between the piston and the compression chamber will be kept small, by virtue of the fact that the diametral clearance is reduced in the region where the difference between the pressure inside the compression chamber and the housing is significant, and the dissipation of mechanical energy will be small, since, in most of the length of the compression chamber, the diametral clearance existing between the piston and the compression chamber will be large and, consequently, the friction will be low.

The objectives of the present invention are achieved by means of a piston-and-cylinder assembly, the piston being displaceably positioned within the cylinder, the cylinder having a compression chamber, the piston moving between an upper dead point and a lower dead point, a diametral clearance separating a slide surface of the piston and a cylinder-guide surface, the guide surface of the cylinder being configured so that the diametral clearance will be variable along the displacement of the piston from the lower dead point to the upper dead point. Said objectives are also achieved by the fact that the variation of the diametral clearance along the displacement of the piston is not linear; the cylinder slide surface, in one of the embodiments, having a first displacement stretch in cylindrical profile and a second displacement stretch in truncated-cone profile, the first displacement stretch being positioned close to the upper dead point; and, in another embodiment, the cylinder having a first displacement stretch in truncated-cone profile and a second displacement stretch in truncated-cone profile, the first displacement stretch being positioned closer to the upper dead point, the cylinder diameter at the upper dead point being smaller than the cylinder diameter at the lower dead point, and the relation of the cylinder diameter towards the side of the upper dead point and the cylinder diameter towards the lower dead point in the first displacement stretch being different from the relation of the cylinder diameter towards the side of the upper dead point and the cylinder diameter towards the side of the lower dead point in the second displacement stretch.

Further, the objectives of the present invention are achieved by means of a cylinder for use on piston-and-cylinder assemblies, the cylinder having a profile with a variable diameter and smaller close to the end of the stroke, the variation of the diameter being non-linear. The cylinder may have a first displacement stretch in cylindrical profile and a second displacement stretch in truncated-cone profile, or still a first displacement stretch in truncated-cone profile and a second displacement stretch in truncated-cone profile, the angle of the second displacement stretch being opener than the angle of the first displacement stretch.

Within the possibilities of having this diametral variation proportional to the force which the gas to be compressed exerts onto the piston, one may foresee a combination of a stretch in truncated-cone profile (during the phase in which the gas exerts lower pressure onto the piston) and a cylindrical profile in the phase in which the piston is close to the minimum at the upper dead point, thus preventing volumetric loss; a combination of two conical profiles, the cone closest to the upper dead point having a more closed angulation, so as to decrease the diametral clearance and thus prevent volumetric loss; or a solution in which the cylinder profile is non-linear and configured so as to decrease the diametral clearance in a manner inversely proportional to the pressure exerted by the gas onto the piston.

BRIEF DESCRIPTION OF THE DRAWINGS

The present invention will now be described in greater detail with reference to an embodiment represented in the drawings. The figures show.

DETAILED DESCRIPTION OF THE FIGURES

Figure 3:
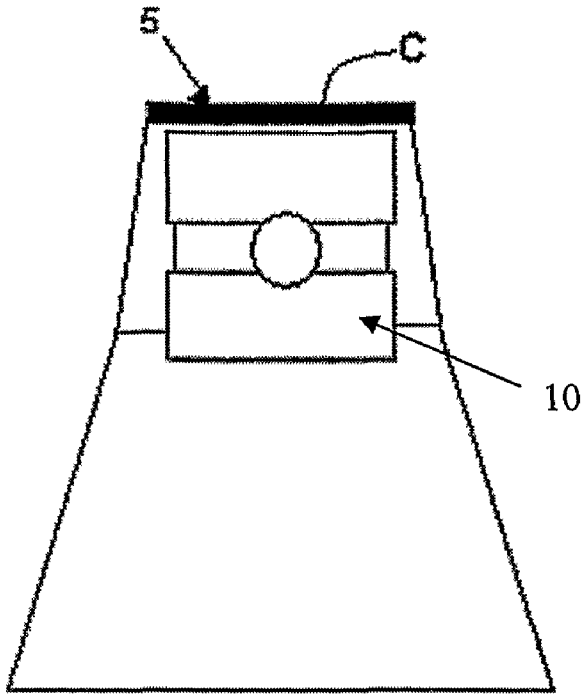
FIG. 3 is a schematized view of the compression chamber shaped as two truncated cones according to the teachings of the present invention.
Figure 4:
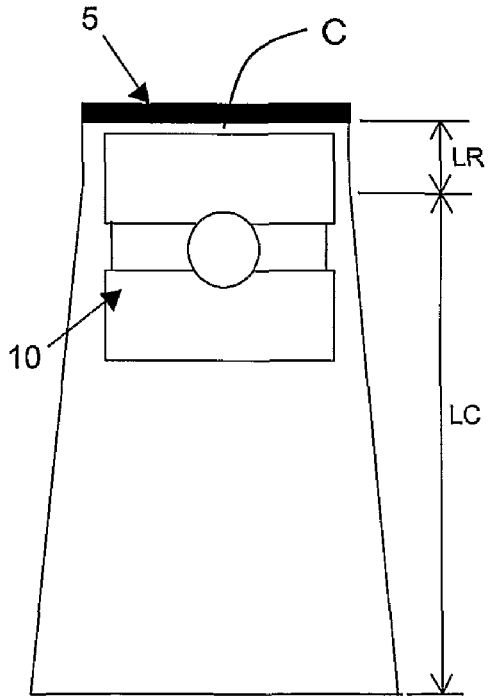
FIG. 4 is a schematized compression chamber having a cylindrical part in another embodiment of the truncated-cone shape according to the teachings of the present invention, wherein the stretch close to the upper dead point (UDP) is cylindrical.

As shown in FIGS. 3 and 4, a piston-and-cylinder assembly is arranged in such a manner that the piston 10 will be displaceably positioned inside the cylinder 11. The cylinder 11 has a compression chamber C. The compression chamber C varies between the minimum volume when the piston 10 is displaced to the upper dead point UDP and a maximum volume when the piston is at a lower dead point LDP. The diametral clearance F separates a piston slide surface 9 (outer surface of the piston 10) and a cylinder guide surface 12 (inner surface of the cylinder 11).

In order to achieve the objectives of the present invention, the slide surface 9 of the cylinder 11 is configured such that the diametral clearance F will vary along the displacement of the piston 10 between the upper dead point UDP and the lower dead point LDP, and this variation may be either liner or non-linear.

Figure 1:
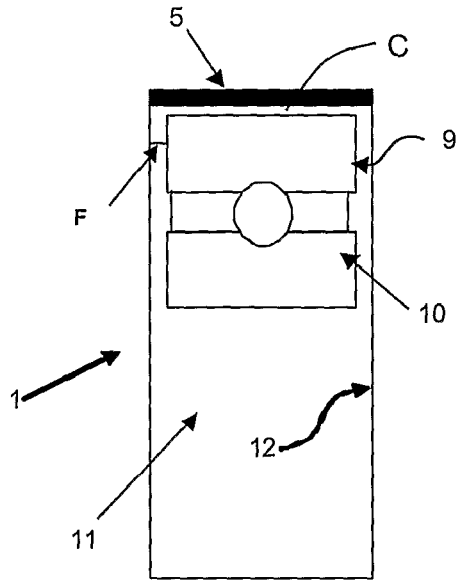
FIG. 1 is a schematized view of a compression chamber of an alternative compressor built according to the teachings of the prior art.
Figure 2:
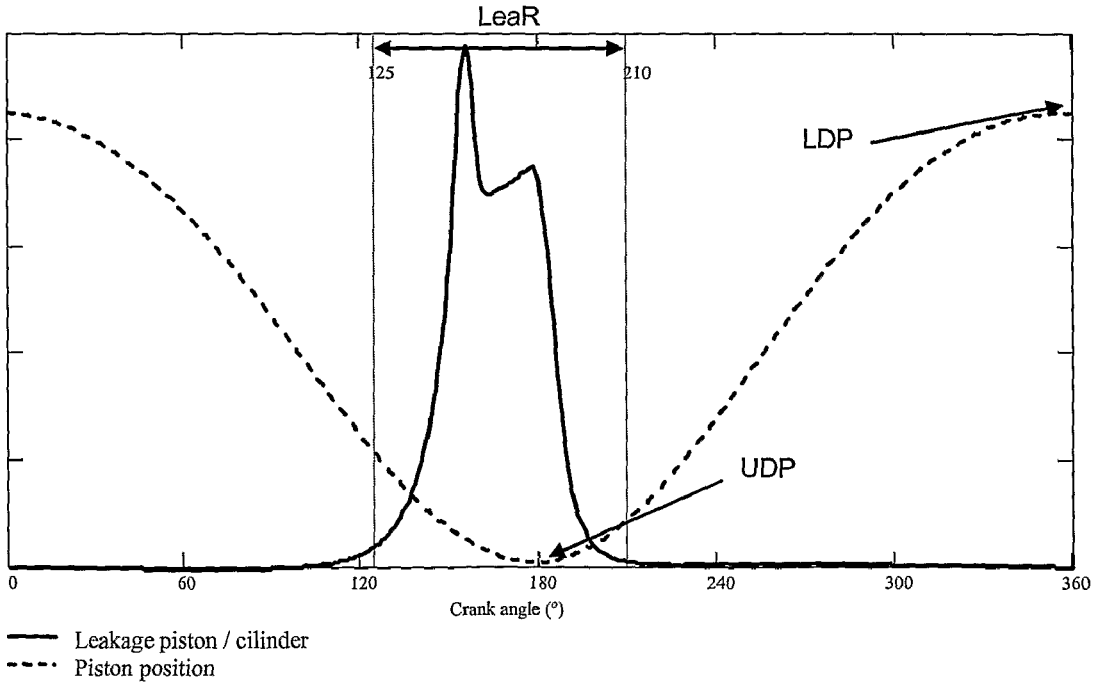
FIG. 2 is a graph showing the relation between the position of the piston and leakage of gas through the clearance existing between the piston and the compression chamber in a function of the crank angle.

One of the embodiments of the present invention can be observed in FIG. 4, which aims at approximating the diametral clearance F to the behavior of the volumetric loss illustrated in FIG. 2. According to this embodiment, the compression chamber will be configured in such a manner that the slide surface 9 of the cylinder 10 will have a first displacement stretch LR in cylindrical profile and a second displacement stretch LC in truncated-cone profile, the fist displacement stretch LR being positioned close to the upper dead point UDP. As can be seen in FIG. 4, the diameter of the truncated-cone profile is minimum close to the upper dead point UDP, and more specifically at the beginning of the displacement stretch LR in cylindrical profile, and is maximum at the lower dead point LDP.

Thus, there will be a region close to the upper dead point UDP in which the diametral clearance F existing between the piston and the compression chamber will be minimum and constant, and a region in which the clearance will be variable in each position of the piston 10, being maximum at the lower dead point LDP.

According to another embodiment of the present invention, shown in FIG. 3, the cylinder 11 may be configured so as to have the first displacement LR in truncated-cone profile and the second displacement stretch LC also in truncated-cone profile, the first displacement stretch LR being positioned close to the upper dead point UPD. In this embodiment, the diameter of the cylinder 11 at the upper dead point UDP is larger than the diameter of the cylinder 11 at the lower dead point LDP. Preferably, the angle of the truncated cone in the second displacement stretch LC is more open than the angle in the first displacement stretch LR, which results in that the relation between the diameter of the cylinder 11 at the upper dead point UDP and at the lower dead point LDP in the first displacement stretch LR is different from the relation between the diameter of the cylinder 11 at the upper dead point UDP and at the lower dead point LDP in the second displacement stretch LC.

In other words, the relation between the cylinder diameter at the upper dead point UPD and towards the side of the lower dead point LDP in the first displacement stretch LR is higher than the relation between the cylinder 11 diameter towards the side of the of the upper dead point UDP and at the lower dead point LDP in the second displacement stretch LC.

The version in which the profile of the cylinder 11 is non-linear and is configured so as to decrease the diametral clearance in a manner inversely proportional to the pressure exerted by the gas onto the piston is not illustrated in the figures, but should have a slide surface adjusted according to the behavior of the gas pressure/gas leakage, as illustrated in FIG. 2. One should make the necessary adaptations for each particular solution of a piston-and-cylinder assembly on which the teachings of the present invention are to be applied.

In all the embodiments described, it is possible to achieve the objectives of the present invention, that is to say, to provide a minimum displacement resistance and, at the same time, prevent leakage of compressed gas, with a diametral clearance adjusted so as to accompany the behavior of the gas within the compression chamber C, thus overcoming the drawbacks of the prior art.

Preferred embodiments having been described, one should understand that the scope of the present invention embraces other possible variations, being limited only by the contents of the accompanying claims, which include the possible equivalents.

The invention claimed is:

1. A piston-and-cylinder assembly comprising a piston displaceably positioned inside a cylinder, the cylinder having a compression chamber, the piston moving between an upper dead point (UDP) and a lower dead point (LDP), a diametral clearance (F) separating a piston slide surface and a cylinder guide surface, the cylinder guide surface being configured so that the diametral clearance (F) will be variable along the displacement of the piston, the diametral clearance (F) being variable from the lower dead point (LDP) to the upper dead point (UDP), wherein the cylinder slide surface has a first displacement stretch positioned close to the upper dead point (UDP) and a second displacement stretch, the second displacement stretch having a truncated-cone profile, a diameter of the truncated-cone profile being relatively larger at a location relatively closer to the lower dead point (LDP) and being relatively smaller at a location relatively closer to the upper dead point (UDP).

2. The piston-and-cylinder assembly according to claim 1, characterized in that the first displacement stretch has a cylindrical profile.

3. The piston-and-cylinder assembly according to claim 2, characterized in that the diametral clearance (F) in the first displacement stretch in cylindrical profile is a minimum.

4. The piston-and-cylinder assembly according to claim 1, characterized in that the diameter of the truncated-cone profile is minimum close to the upper dead point (UDP) and maximum at the lower dead point (LDP).

5. The piston-and-cylinder assembly according to claim 1, characterized in that the first displacement stretch has a truncated-cone profile the diameter of the cylinder at the upper dead point (UDP) being smaller than the diameter of the cylinder at the lower dead point (LDP), and the relation between the cylinder diameter of the side of the upper dead point (UDP) and the cylinder diameter at the side of the lower dead point (LDP) in the first displacement stretch being different from the relation between the cylinder diameter of the side of the upper dead point (UDP) and the cylinder diameter at the side of the lower dead point (LDP) in the second displacement stretch.

6. The piston-and-cylinder assembly according to claim 5, characterized in that the relation between the diameter of the cylinder at the side of the upper dead point (UDP) and the side of the lower dead point (LDP) in the first displacement stretch is larger than the relation between the diameter of the cylinder at the side of the upper dead point (UDP) at the side of the lower dead point (LDP) in the second displacement stretch.

7. The piston-and-cylinder assembly according to claim 1, characterized in that the diametral clearance (F) is proportional to the force which the gas to be compressed in the compression chamber exerts onto the piston.

8. A cylinder for use on piston-and-cylinder assemblies having a profile with a diameter that is variable and smaller at the end of the stroke, the diameter variation being non-linear, the cylinder being characterized in that the cylinder has a first displacement stretch and a second displacement stretch, the second displacement stretch have a truncated-cone profile, wherein the first displacement stretch has a truncated-cone profile, a cone angle of the second displacement stretch being larger than a cone angle of the first displacement stretch.

* * * * *